US007334791B2

(12) United States Patent
Lindsey et al.

(10) Patent No.: US 7,334,791 B2
(45) **Date of Patent: *Feb. 26, 2008**

(54) ELECTRONIC DIE

(75) Inventors: Michael K. Lindsey, Barrington, IL (US); Stephen J. Pearson, Ingleside, IL (US)

(73) Assignee: Blinky Bones, Inc., Tucson, AZ (US)

( * ) Notice: Subject to any disclaimer, the term of this patent is extended or adjusted under 35 U.S.C. 154(b) by 308 days.

This patent is subject to a terminal disclaimer.

(21) Appl. No.: 10/782,274

(22) Filed: Feb. 19, 2004

(65) Prior Publication Data

US 2004/0160000 A1 Aug. 19, 2004

Related U.S. Application Data

(63) Continuation-in-part of application No. 10/227,129, filed on Aug. 24, 2002, now Pat. No. 7,017,905.

(51) Int. Cl.
*A63F 9/04* (2006.01)

(52) U.S. Cl. ..... 273/146; 463/22

(58) Field of Classification Search ..... 273/146; 264/217.1, 272.11, 238, 349
See application file for complete search history.

(56) References Cited

U.S. PATENT DOCUMENTS

| | | | | |
|---|---|---|---|---|
| 2,338,811 | A | 1/1944 | Hasbrook | 33/206 |
| 2,611,188 | A | 9/1952 | Bell | 33/206 |
| 2,881,892 | A | 4/1959 | Ylinen | 194/17 |
| 2,903,820 | A | 9/1959 | Bodell | 46/228 |
| 3,096,591 | A | 7/1963 | Higgins Jr. et al. | 33/206 |
| 3,225,450 | A | 12/1965 | Stanley | 33/206 |
| 3,225,460 | A | 12/1965 | Randell et al. | 35/22 |
| 3,253,280 | A | 5/1966 | Feyling | 346/108 |

(Continued)

FOREIGN PATENT DOCUMENTS

DE 19540025 6/1997

(Continued)

OTHER PUBLICATIONS

Web page ad for "Palco Marketing Retail Site", http://www.palcomarketing.com/dice.htm, 4 pages, Nov. 2, 2001.

(Continued)

*Primary Examiner*—Robert E. Pezzuto
*Assistant Examiner*—Alex F. R. P. Rada, II
(74) *Attorney, Agent, or Firm*—Gavrilovich, Dodd & Lindsey LLP

(57) ABSTRACT

An ostensibly solid electronic die presents visual and/or sound effects when in use. Unlike known electronic dice, the disclosed electronic die retains the weight, feel and ruggedness of conventional non-electronic dice. The die includes an outer shell defining its shape. Electronics for producing the effects are located inside the shell. The shell is preferably filled with potting material and sealed shut. The use of potting material is a unique aspect of the invention that represents a significant advance over known electronic dice. The potting material gives the inventive die added weight and safely encases the electronics. Using miniaturized electronics and batteries, the die can have physical dimensions and weight that are the same as or similar to a conventional hand-tossed gaming die.

20 Claims, 8 Drawing Sheets

U.S. PATENT DOCUMENTS

| | | | | | |
|---|---|---|---|---|---|
| 3,271,650 | A | | 9/1966 | Riddle | 318/489 |
| 3,290,786 | A | | 12/1966 | Parkin | 33/206 |
| 3,304,651 | A | | 2/1967 | Deyerl | 46/228 |
| 3,357,703 | A | | 12/1967 | Hurley | 273/138 |
| 3,400,932 | A | | 9/1968 | Conrad | 273/146 |
| 3,450,408 | A | | 6/1969 | Hagerman | 273/146 |
| 3,459,427 | A | | 8/1969 | Rhodes | 273/138 |
| 3,478,437 | A | | 11/1969 | Cothran | 33/206 |
| 3,487,303 | A | | 12/1969 | Remington | 324/65 |
| 3,495,832 | A | | 2/1970 | Thomassen-Behle | 273/146 |
| 3,592,473 | A | | 7/1971 | Jernakoff et al. | 273/138 A |
| 3,645,532 | A | | 2/1972 | McNaney | 273/142 A |
| 3,659,853 | A | | 5/1972 | Church | 273/138 A |
| 3,709,499 | A | | 1/1973 | Lukens, Jr. | 273/138 A |
| 3,715,624 | A | | 2/1973 | Herman | 315/209 |
| 3,755,241 | A | * | 8/1973 | Brady | 524/267 |
| 3,791,650 | A | | 2/1974 | Dice | 273/138 A |
| 3,896,574 | A | | 7/1975 | McNaney | 40/34 |
| 4,034,988 | A | | 7/1977 | Goldner et al. | 273/138 A |
| 4,124,881 | A | | 11/1978 | Haber et al. | 362/253 |
| 4,148,488 | A | | 4/1979 | Kohlhagen | 273/146 |
| 4,181,304 | A | | 1/1980 | Haber | 273/146 |
| 4,431,189 | A | | 2/1984 | Wiencek et al. | 273/138 A |
| 4,506,890 | A | | 3/1985 | Murry | 273/138 A |
| 4,603,484 | A | | 8/1986 | Strothmann | 33/366 |
| 4,641,840 | A | * | 2/1987 | Larson | 463/22 |
| 4,669,728 | A | | 6/1987 | Carden | 273/138 A |
| 4,672,753 | A | | 6/1987 | Kent et al. | 33/366 |
| 4,809,979 | A | * | 3/1989 | Skowronski et al. | 463/9 |
| 4,858,931 | A | | 8/1989 | McKechnie | 273/138 A |
| 4,909,513 | A | | 3/1990 | Kiyono | 273/145 R |
| 5,031,914 | A | | 7/1991 | Rosenthal | 273/146 |
| 5,155,442 | A | | 10/1992 | Mercer | 324/690 |
| 5,238,249 | A | | 8/1993 | Elias et al. | 273/138 A |
| 5,344,145 | A | | 9/1994 | Chadwick et al. | 273/138 A |
| 5,348,300 | A | | 9/1994 | Jennings | 273/146 |
| 5,428,902 | A | | 7/1995 | Cheah | 33/366 |
| 5,625,955 | A | | 5/1997 | Han | 33/366 |
| 5,694,045 | A | * | 12/1997 | Ikeda et al. | 324/652 |
| 5,885,157 | A | | 3/1999 | Harada et al. | 463/22 |
| 6,066,955 | A | | 5/2000 | Zeller et al. | 324/716 |
| 6,220,594 | B1 | | 4/2001 | Peng | 273/146 |
| 6,331,145 | B1 | | 12/2001 | Sity et al. | 463/22 |
| 6,394,903 | B1 | * | 5/2002 | Lam | 463/22 |
| 6,588,748 | B2 | * | 7/2003 | Solow et al. | 273/146 |
| 7,017,905 | B2 | * | 3/2006 | Lindsey | 273/146 |
| 2001/0014622 | A1 | | 8/2001 | Hazama | 463/36 |
| 2005/0164778 | A1 | * | 7/2005 | Cooney | 463/22 |

FOREIGN PATENT DOCUMENTS

| | | |
|---|---|---|
| DE | 197 02 012 A1 | 7/1998 |
| GB | 2288547 | 10/1995 |
| JP | 2000084241 | 3/2000 |
| WO | WO 99/11344 | 3/1999 |
| WO | WO 00/52672 | 9/2000 |

OTHER PUBLICATIONS

Web page ad from http://audiovideoone.com/store/p000282.htm, showing Liteglow Illuminated Fuzzy Dice, 1 page, Nov. 2, 2001.

Web page ad from http://www.wolo-mfg.com/light.htm, showing "Dice That Lite" fuzzy dice, 1 page, Nov. 2, 2001.

Web page ad from http://www.qkits.com/serv/qkits/velleman/pages/K3400.asp, showing Dual Electronic Dice Kit, 1 page, Nov. 2, 2001.

Web page ad from http://gibsonteched.net/vmk109.html, showing Electronic Dice Kit available from Gibson Tech Ed, Inc., 2 pages, Nov. 2, 2001.

Web page ad from http://www.qkits.com/serv/qkits/maplin/pages/LM99.asp, showing Electronic Digidice Kit, 1 page, Nov. 2, 2001.

The front and back of packaging for Electro™ Dice from Palco Marketing, Inc, 1 page, no date.

Web page ad for Toy Dice from Russell Martin & Associates, http://store.yahoo.com/russellmartinandassociates/flashingdice1.html, Jan. 7, 2003.

Supplementary Partial European Search Report, European Patent Office, EPO patent application No. 03793142.5, Jul. 24, 2007, 5 pages.

* cited by examiner

ELECTRONIC DIE

RELATED APPLICATION

This application is a continuation-in-part of application Ser. No. 10/227,129, filed on Aug. 24, 2002 now U.S. Pat. No. 7,017,905, which is owned in common by the assignee hereof, and which is fully incorporated herein by reference as though set forth in full.

TECHNICAL FIELD

The present invention relates generally to games, toys and novelty devices, and in particular, to dice suitable for playing games.

BACKGROUND

Dice have been known and used for thousands of years. In some form or another, dice have appeared in many different cultures throughout history. For example, dice are depicted on some ancient Egyptian monuments, and they were used for playing games and gambling throughout ancient Greece and Rome.

In contemporary times, dice are available in variety of different shapes and sizes. The number of sides (a.k.a., facets or faces) on a die can range from just a few to dozens, and the size of a die can vary widely, from the very minute to the very large. A fairly standard size for a conventional six-sided die is about 16 millimeters along an edge. Dice are known to have numbers, letters, dots, or other symbols printed, drilled or embossed on their sides.

Conventional modern gaming dice are cubes having dots on their sides representing the numbers one through six. The dots are placed on respective die faces so that the sum of the dots on opposite sides is always seven. Thus, the numbers one and six appear on opposite sides of the cube, two is opposite five, and three is opposite four.

With the advent of electronics, various types of "electronic dice" have been developed to increase the entertainment value and interest in using dice. Generally, electronic dice are dice that include some sort of electronic or electrical components. A limitation of known electronic dice is that they simply do not have the look, feel or ruggedness of conventional gaming dice.

For example, Maui Toys, Inc. distributes an electronic die that is a hollow, transparent, plastic cube measuring approximately one inch on a side. Enclosed within the hollow cube are two light emitting diodes (LEDs), an LED flasher circuit, coin cell batteries, and a movement sensitive spring switch for triggering the circuit to cause the two LEDs to flash. The LEDs are internal to the die. Conventional dot patterns are painted on the exterior faces of the die. No LEDs or other lights are located on the faces. The die is hollow, relatively light weight, and plainly does not have the look and feel of a regular gaming die. Moreover, the Maui die is not obviously modifiable to be solid because its LEDs would not be visible if it were solid and because its spring switch has exposed moving parts that would not function if encased in a solid material.

The ELECTRO™ DICE, available from Palco Marketing, Inc. of Plymouth, Minn. (www.palcomarketing.com/dice.htm or www.electrodice.com), feature a pair of spherically-shaped electronic dice, each having an exposed square cavity formed opposite a flat side on the sphere. Within the square cavity are seven light-emitting diodes (LEDs) arranged to represent the dots on the face of a conventional die. Batteries, a movement sensor, a piezoelectric noisemaker, and an electronic circuit for randomly generating numbers are contained within the hollow spherical body. When the ELECTRO™ DICE are tossed, they land upright on their flat sides and randomly display numbers using the LEDs, while making sounds. Although the ELECTRO™ DICE provide an innovative and entertaining approach to electronic dice, they forgo the conventional dice-action aspect of being rolled or tumbled to randomly select a facet, and instead rely on their electronics to randomly generate numbers.

Japanese Patent No. JP20000S4241 to Kimura Masaki discloses a game machine having a dice-like look and feel. The cubic housing of the game machine is about six centimeters on a side and contains an IC circuit (sic) programmed with a game and power source. The dots of the die are lighted push buttons for operating the game. A liquid crystal display (LCD) and two switches—a game selection switch and an on-off switch—are located on one exterior side of the housing. The game machine is not designed to be tossed in order to determine an outcome.

U.S. Pat. No. 6,394,903 discloses a six-sided toy die that includes six different playing functions, one associated with each side. The playing function are essentially different games for children. When the toy die is rolled, the game on the upward side can be played. The games include a letter matching game, a phone dialing game, and so forth. Internally, the die includes a controller and sound generator for producing music, voice and noises. The die is also includes an internal gravity switch, as well as LEDs associated with push buttons located on the exterior of the die. Although the toy die of the '903 patent has many appealing features, it is clearly not intended to be used for the random selection of a number or outcome, like a conventional die.

PCT Patent Application Nos. WO 00/52672 and WO 99/11344, and related U.S. Pat. No. 6,331,145 disclose a six-sided electronic die having a conventional appearance, but containing within itself a programmable micro-controller circuit and a radio frequency (RF) transceiver for transmitting data identifying which face is lying down on a surface. At least one tilt sensor is included in the die for indicating which face is down. The die does not include lights or any means for generating sounds or visual displays.

U.S. Pat. No. 6,220,594 discloses a device for automatically discriminating the spot pattern of an upward face of a six-sided die. The die includes an embedded transmitter and mercury switches for transmitting positional information. The die does not include any means for generating sounds or visual displays.

U.S. Pat. No. 4,858,931 discloses an electronic die having a cube-shaped, hollow housing that contains batteries and an electronic circuit for randomly generating two numbers from one to six inclusive. The top side of the housing includes two identical rectangular display sections with each section having seven light emitting elements mounted therein. The electronic circuit is actuated by manually shaking the die. When the shaking stops, the two random numbers that are finally selected are illuminated in the display sections. The electronic die of the '931 patent is not intended to be tossed or thrown like a conventional die, and instead, its electronics are used to randomly determine an outcome.

U.S. Pat. No. 4,641,840 discloses a cubic electronic die having seven-segment numeric displays on each of its six facets. Within the hollow cube are a battery, a motion sensing switch and an electronic circuit for generating random numbers. While the die is moving, the circuit generates a series of random numbers on the displays. Once the motion stops, the random number occurring last is displayed on all six facets.

U.S. Pat. No. 4,431,189 discloses a device for simulating the roll of a die. The device includes an electronic circuit housed within an elongated housing. The circuitry includes logic that simulates the random nature of rolling conventional dice. A multi-position switch is provided so that the logic circuitry can selectively simulate dice behavior characteristic of dice having different numbers of side, such as four-sided, eight-sided, twelve-sided, twenty-sided, or one-hundred-sided dice.

U.S. Pat. No. 4,181,304 discloses illuminated dice in combination with a storage housing for the dice. The dice are provided with light-emitting numeric displays on their surfaces, together with a battery, gravity-responsive switch and master switch contained within each die. The gravity-responsive switch causes the battery to be coupled to the upward facing side of the die, thereby illuminating only the upwardly facing numeric display. The separate housing includes small projections for reception in small holes formed on one face of each die to open the master switch in each die so that there will not be drainage on the batteries when the dice are stored.

U.S. Pat. No. 4,124,881 discloses a pair of multifaceted dice having numeric displays that light up. Each of the facets bear an numeric display and each side supports an internal switch that operates to illuminate only the upward facing side of the dice after having been rolled and coming to rest.

U.S. Pat. No. 4,034,988 discloses an electronic dice game in which an electronic circuit and battery are supported within a rectangular housing having two sets of seven light-up display elements on single face to represent the spots of a conventional pair of dice. Control switches and a plug-in socket are externally located on another housing face. The electronic circuit includes a timer that simulates the random characteristic of rolling of conventional dice. In its intended use, the electronic dice of the '988 patent simulate the dice-playing activity by randomly generating combinations of illuminated spot elements on the single facet. An audible oscillator simulates the sound of rolling dice. Although the electronic dice game of the '988 patent may have appeal, it is not designed or intended to be tossed or thrown like conventional dice.

U.S. Pat. Nos. 3,715,624 and 3,459,427 disclose early efforts to combine electronic circuitry with playing dice, and each includes a random generator which randomly illuminates the spot patterns associated with conventional dice in a manner intended to simulate the action of rolling dice.

U.S. Pat. No. 3,450,408 discloses a hollow die having lighted faces of different colors. Located within the die is a composite mercury switch that operates to light only the upward facing side of the die. Nowadays, the known hazards of mercury make the '408 die undesirable for toys and novelty items.

U.S. Pat. No. 2,881,892 discloses a game apparatus including a cube with conventional dice dot patterns for the numbers two through six on its side and upper facets. The apparatus sequentially illuminates each of the dot patterns on the facets in a rapid, serial manner using a rotatable contact switch driven by an electric motor. A player attempts to activate a manual breaking device that stops the movement of the contact switch. The object is to apply the braking device with sufficient skill to select the desired dot pattern.

Although the foregoing electronic dice may provide a certain degree of entertainment value, there is a need for an improved electronic die that further enhances the excitement and appeal of using dice.

SUMMARY

It is an advantage of the present invention to provide an improved electronic die that is ostensibly solid and that, when in use, presents visual and/or sound effects. The solid feel, weight and ruggedness of the inventive die is vast improvement over known electronic dice.

In accordance with an exemplary embodiment of the invention, an electronic die includes a six-sided, cube-shaped shell defining the exterior of the electronic die. Each side of the cube-shaped shell represents a predetermined outcome that is distinct from the outcomes represented by the other sides of the cube-shaped shell. Plural light-emitting pips are located on the sides of the shell, which represent the numbers one through six, respectively. An electronic circuit, located within the shell, causes the light-emitting pips to light up in a pattern that has a predetermined duration. The electronic circuit includes an integrated circuit (IC) for illuminating one or more light sources, which illuminate the light-emitting pips according to the pattern. The IC is circuit-on-board (COB) mounted to a printed circuit board (PCB) and configured in a one-shot mode. Also located within the shell is a sensor for triggering the electronic circuit in response to the electronic die being physically manipulated and at least one battery for powering the electronic circuit.

In accordance with another embodiment of the present invention, an electronic die includes an outer shell, which defines the shape of the die. Electronics are located inside the outer shell. Potting material, such as a self-curing plastic resin, fills the shell and encases the electronics. The use of potting material is a unique aspect of the present invention that distinguishes it from known electronic dice.

The added potting material gives the die the weight and feel of a regular, non-electronic die. This increases its appeal. In addition, the potting material also holds the internal electronics in place, making the die extremely rugged so that it can be thrown like a regular die without damage to the electronics. Thus, unlike many known electronic dice, the die retains the conventional dice-action aspect of being rolled to randomly select a facet displaying a particular number or symbol. Also, the potting material increases the safety of using the die because with certain potting materials, the die is extraordinarily unlikely to break into smaller pieces during normal use.

The electronics of the inventive die present visual and/or audio effects during use. These effects can also be patterned to further increase the appeal and entertainment value of the die. In addition, using miniaturized electronics and batteries, the die can also have physical dimensions that are the same as or similar to a conventional hand-tossed gaming die. The electronic die can be used individually, or in sets of two or more, for amusement or to play dice games, such as board games or games of chance.

In addition, the invention extends to other devices that are physically manipulated, e.g., rolled, tossed, flipped, spun etc., to randomly determine an outcome. Such devices include items such as coins, tops or dradles.

A counterpart process for manufacturing the electronic die is also disclosed. Other embodiments, features and advantages of the invention will be or will become apparent to one with skill in the art upon examination of the following figures and detailed description. It is intended that all such additional features, embodiments and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention.

DETAILED DESCRIPTION

Figure 1:
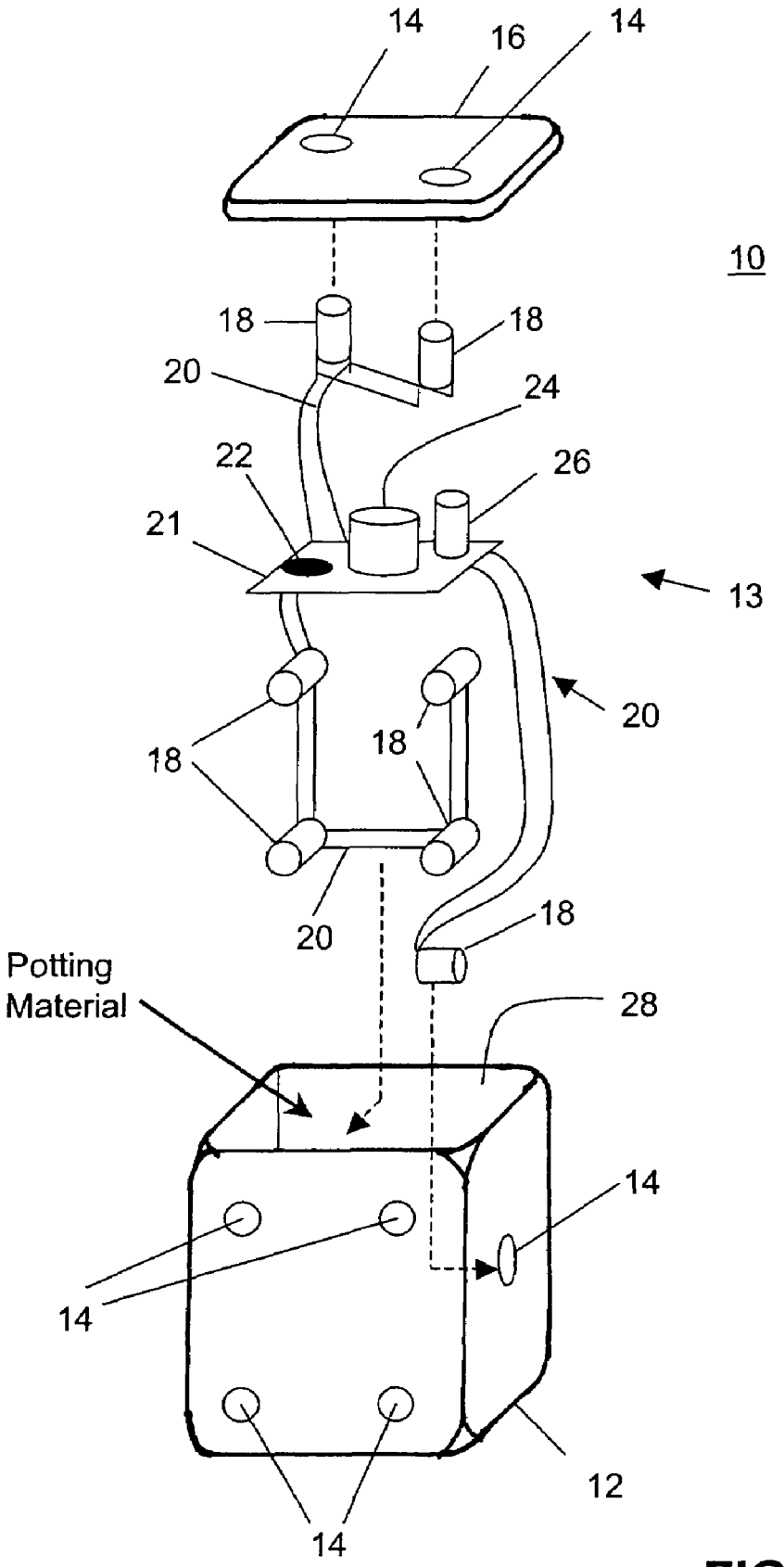
FIG. 1 is an exploded view of an electronic die in accordance with a first exemplary embodiment of the present invention.

Turning now to the drawings, and in particular to FIG. 1, there is illustrated an exploded view of an electronic die 10 in accordance with a first exemplary embodiment of the invention. The electronic die 10 includes an outer shell 12, such as a cube-shaped box, having an opening 28 on one side and a plurality of thru-holes 14 on the remaining five sides. The thru-holes 14 are arranged in a pattern representing the dots of a six-sided die. A lid 16 is provided for sealing the box 12 shut. The lid 16 is mated to the opening 28 and it has at least one thru-hole 14.

Electronics 13 are placed inside of the outer shell 12. The electronics 13 can include any suitable electronic component(s) (e.g., light emitters, circuit board, integrated circuit (IC), microprocessor, memory, sound playback circuit, audio circuit, speaker, batteries, radio frequency (RF) component or the like) for producing visual and/or audio effects, or for performing any other desired function, such as wireless communications with other devices.

In the example shown, the electronics 13 include a plurality of light emitters, e.g. light emitting diodes (LEDs) 18, connected to a circuit comprising a printed circuit board (PCB) 21 having mounted thereon an LED flasher integrated circuit (IC) 22, one or more batteries 24 for powering the circuit and LEDs 18, and a momentary contact spring switch 26. The circuit causes the LEDs 18 to flash in response to the die 10 being physically manipulated, e.g., shaken, tapped, rolled, tossed, etc. The LEDs 18 are connected together using wires 20 into assemblies corresponding to each side of the die 10. The assembled LEDs 18 are mounted in the thru-holes 14 of the box 12 and lid 16, sealing shut the thru-holes 14.

After the electronics 13 are placed within the outer shell 12, the outer shell 12 is filled with potting material, encasing the electronics 13. Although the invention contemplates filling entirely the outer shell 12 so as to remove all air space, this is not necessary, and it is preferable that the potting material fill the outer shell 12 to the extent that it holds the electronics 13 in place during use and so that a user perceives the electronic die 10 as being solid. The potting material ruggedizes the die 10 and gives it the weight and feel of a conventional non-electronic die.

After putting the potting material in the outer shell 13, the lid 16 is set in the opening 28 and held in place by friction fit with the side walls of the opening 28, an adhesive, and/or adhesion with the potting material. This forms the completed electronic die 10.

The outer shell 12 and lid 16 can be made of any formable material, such as metal, wood, or plastic, and are preferably made of an injection molded plastic, such as ABS or polycarbonate.

The potting material can be any suitable material for filling the interior of the outer shell 12 that does not interfere with operation of the electronics 13. Preferably, the potting material is a two-part self-curing liquid plastic resin that solidifies after being poured into the outer shell 12, such as a two-part urethane resin. Among other things, the plastic resin is advantageous in that it embeds the electronics 13 in a hard, protective casing that makes the die 10 as tough and rugged as conventional non-electronic dice. This level of ruggedness has not been achieved by prior art electronic dice that present visual and/or audio effects, and it dramatically increases the appeal of the electronic die 10 because the die 10 retains the look and feel of a regular die, while adding the enjoyment of light and sound effects. Other potting materials can be used, such as different types of curing plastics, including epoxy, polyurethane, acrylic, or silicone based materials, non-curing plastics, such as plastic granules, and even non-plastic materials, such as sand, dry granules, and further, any suitable combination of the foregoing materials.

The batteries 24 can be any suitable power source, and are preferably one or more coin cell batteries providing a 3 volt or higher supply of electricity to the other electronic components in the die 10. Battery holders (not shown) are used to fasten the batteries 24 to the PCB 21.

The LED flasher IC 22 is a commercially-available IC for flashing LEDs, such as the 6-LED flasher, part no. 5416 from China Resources Semiconductor, Ltd. In the example described herein, the IC 22 is set in a one-shot mode so that it causes the LEDs 18 to flash for a predefined period of time after the IC 22 is triggered. After flashing, the IC 22 goes into a low power standby state. This preserves the battery life and increases the useful life of the die 10 to the point where it allows the die 10 to be sold as sealed, non-serviceable unit without upsetting consumer expectation. The IC 22 is circuit-on-board (COB) mounted onto the PCB 21 to reduce the size of the circuit. In addition, passive elements (a capacitor and/or resistor) having selected values can be connected to the IC 22 to change the flashing frequency and duty cycle.

The spring switch 26 can be any suitable electric switch for triggering the LED flasher IC 22 when the die 10 is being used. Preferably, the spring switch 26 is a sealed spring switch that can be embedded in plastic resin without affecting its function, such as part no. SW-18015P available from Gaoxin Electronics of China. A sealed spring switch has a hollow outer casing with electrical leads protruding therefrom. Located inside the case are a fixed conductor and a fine-wire coil spring. When the sealed switch receives a physical impact, the coil spring hits the fixed conductor, closing the circuit.

In use, the die 10 is rolled to randomly select an upwardly-facing side indicating an outcome, displayed as a particular number of dots. The shaking and rolling triggers the spring switch 26, which turns on the electronics 13 inside the die 10, causing the LEDs 18 to flash. The flashing can last for a predetermined time period, after which it stops and the electronics turn off. The LEDs 18 can be wired to the circuit so that they flash in a particular pattern. The pattern can be designed to increase the overall appeal of using the die 10. In addition, using miniaturized electronics and batteries, the die 10 can also have physical dimensions that are the same as or similar to a conventional hand-tossed gaming die.

Although the light emitters are shown as discrete LEDs 18, the light emitters can be any suitable light-emitting device, such as miniature bulbs or the like.

Figure 9:
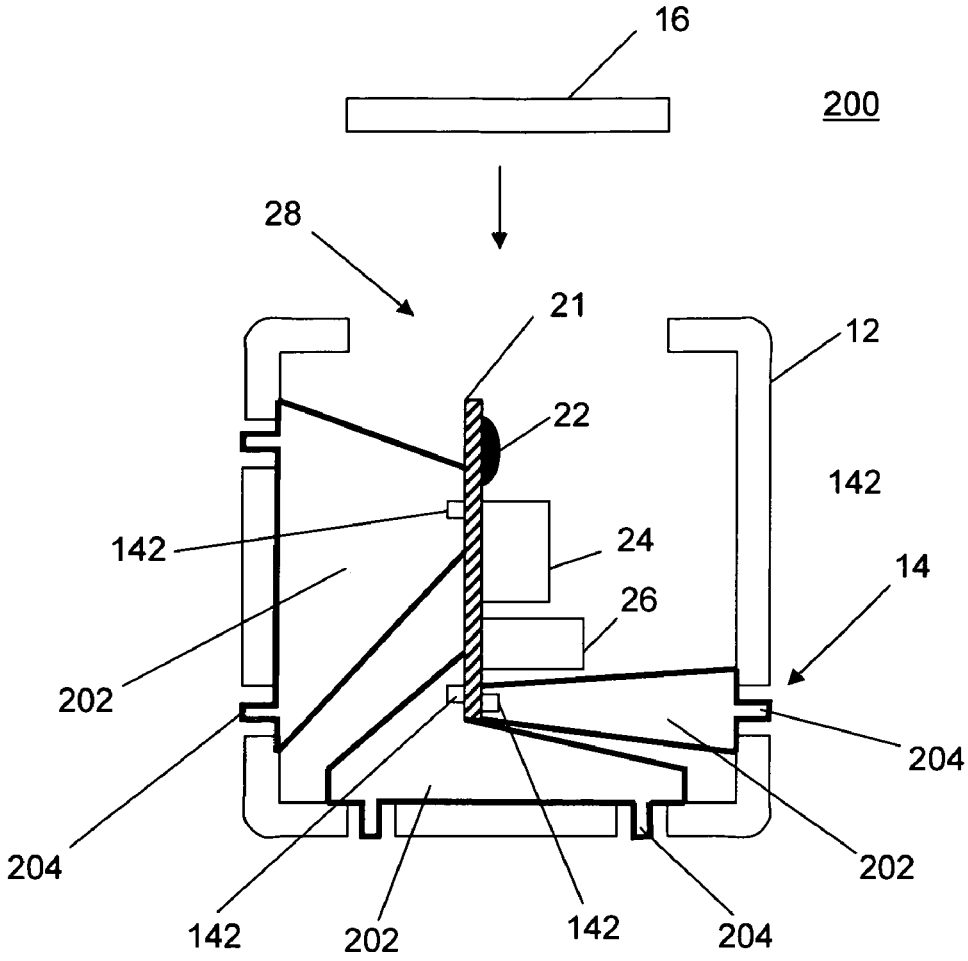
FIG. 9 is a cross-sectional view of an electronic die in accordance with another exemplary embodiment of the present invention.

In an alternative embodiment of the electronic die 200 shown in FIG. 9, a light emitter can include a light source internal to the outer shell 12 and a light pipe 202 for a directing light from the source to the external surface of the outer shell 12. Using this type of light emitter, a single light source can be used for multiple dots, e.g., one light for each die side, with plastic, light-transmissive piping (light pipes) 202 channeling light from the light source to each of the dots on a respective face. In this alternative arrangement, six or more lights are set into the interior of the die 200. A transparent light manifold 202 is attached to each light. The light sources are preferably discrete LEDs or surface mounted LEDs 142 placed on the circuit board 21. The light manifolds 202 are formed of plastic, each having an end for attaching to the light source and one or more fingers 204 terminating with flat ends representing the dots. The manifolds pipe the light from the light sources to the dots. For the six-sided die 10 of FIG. 9, only six lights are needed, rather than the twenty-one required if each dot is represented by an individual light. This can reduce the cost of manufacturing the die 200.

The color of the LEDs 18 can be one that is desirable and available for the chosen light source.

The patterns displayed by the LEDs 18 can include predefined sequences of flashing the LEDs 18 on and off in particular orders for specific durations. For example, a display pattern can flash the LEDs 18 in a sequence of opposite sides.

The exterior surface of the die 10 can be plated and/or painted to further increase the die's 10 appeal.

Figure 2:
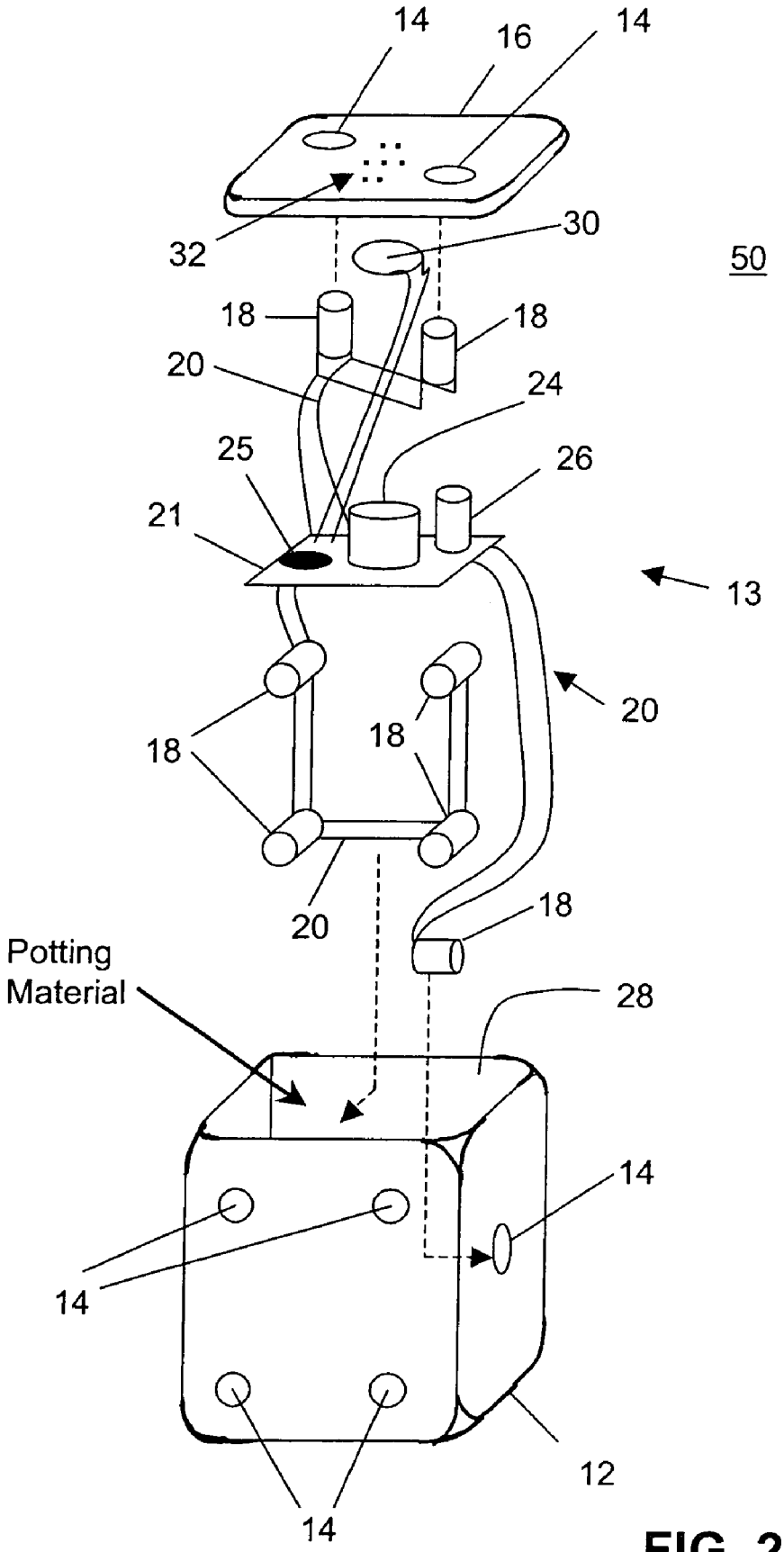
FIG. 2 is an exploded view of an electronic die in accordance with a second exemplary embodiment of the present invention.

FIG. 2 is an exploded view of an electronic die 50 in accordance with a second exemplary embodiment of the present invention. This embodiment includes components for generating both visual and audio effects. The die 50 includes most of the elements of the electronic die 10 shown in FIG. 1, and further includes circuitry 25 for generating both light and sound, and a sound source 30, such as a speaker or piezo-electric bender. One or more holes 32 are formed in the lid 16 for allowing the sound to easily escape from the interior of the die 50. Shapes other than holes 32 can be used as sound openings. The sound source 30 and holes 32 can be alternatively located on one of the walls of the outer shell 12 rather than the lid 16. The sound source 30 can be housed in its own casing so that the potting material does not interfere with its operation. The casing can be integrally formed on the interior wall of the lid 16 or outer shell 12, or alternatively, it can be a separate housing formed around the sound source and attached to the lid 16 or outer shell 12.

The circuitry 25 can include any suitable electronic circuitry for generating sound and flashing LEDs or operating other visual displays. Such circuitry is commercially-available. Suitable audio playback chips for sound generation are available from Sunplus of Taiwan and ISD. The generated sound can include music, noises and/or voice messages. The circuitry 25 can include an LED flasher IC, such as the one described in connection with FIG. 1, and an audio playback IC, where both ICs are triggered by the spring switch 26.

Figure 3:
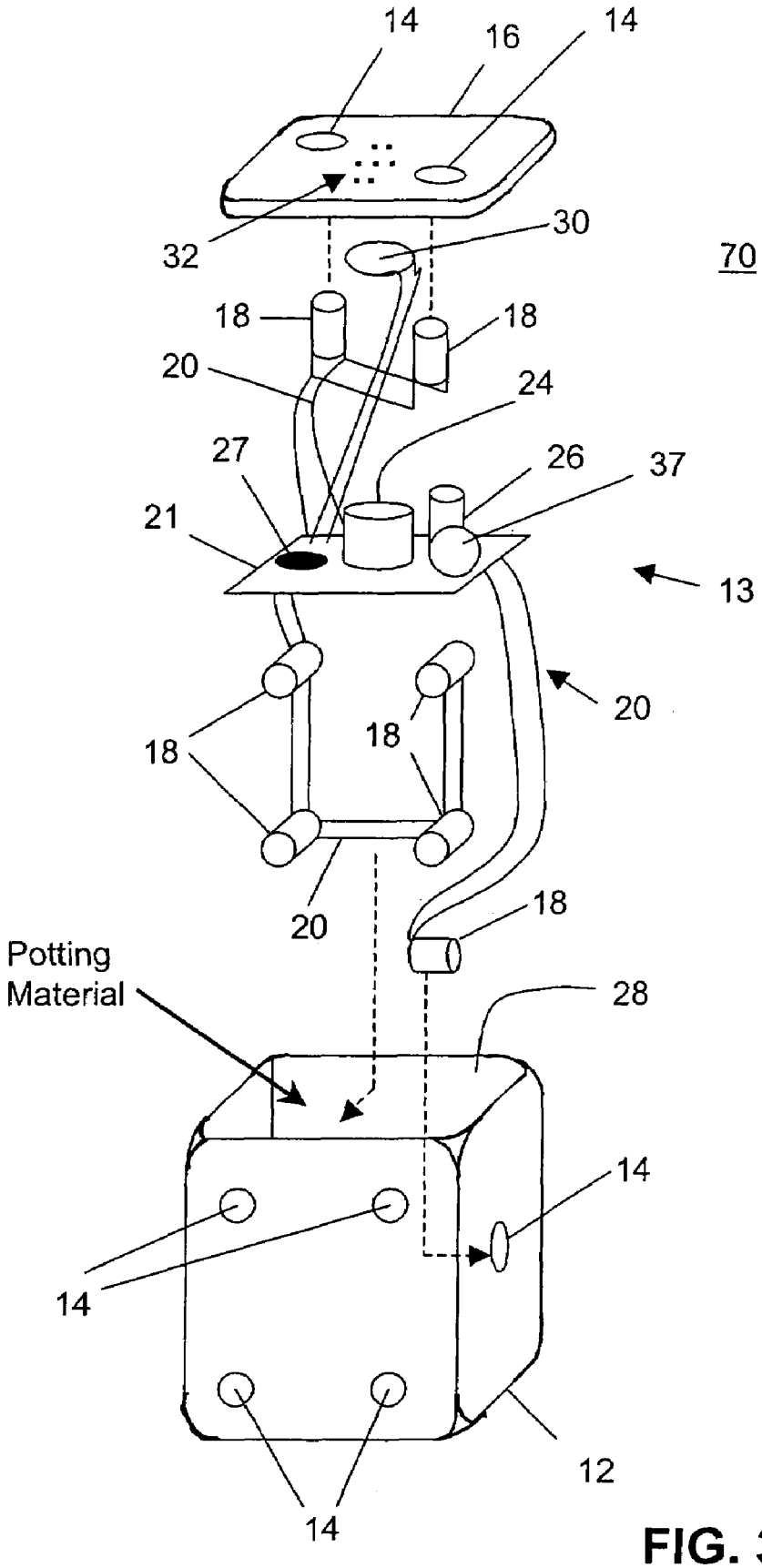
FIG. 3 is an exploded view of an electronic die in accordance with a third exemplary embodiment of the present invention.

FIG. 3 is an exploded view of an electronic die 70 in accordance with a third exemplary embodiment of the present invention. In addition to the components of the die 50 shown in FIG. 2, this embodiment includes a gravity switch 37 for indicating the top-facing side of the die 70. The gravity switch 37 is coupled to the circuitry 27 so that the visual and/or audio effects can correspond to the top-facing side of the die 70. For example, with the gravity switch 37, when the die 70 is rolled, the LEDs 18 on the top-facing side can persistently remain on while the other sides flash. Also, the gravity switch 37 allows the sound circuitry to annunciate the roll of the die 70. For example, if the die 70 is rolled to show '6', the sound circuitry can announce "You rolled a six", as well as light persistently the LEDs 18 on the '6' side and flash LEDs 18 on the other sides. Announcing the roll is particularly helpful for young children who do not know how to count the dots. The sound circuitry can also be configured to play other messages and noises. To get the circuitry 27 to play a message corresponding to each side, the messages are stored at six different starting addresses in the audio playback circuit. Each of the six output conductors of the gravity switch 37 is connected to the audio playback circuit to correspond to a respective starting address.

FIG. 3 shows the electronics 13 including both the spring switch 26 and gravity switch 37. This arrangement is useful in some situations; however, it is noted that when the gravity switch 37 is used, the circuitry can be designed so that the spring switch 26 is not necessary.

Figure 4A:
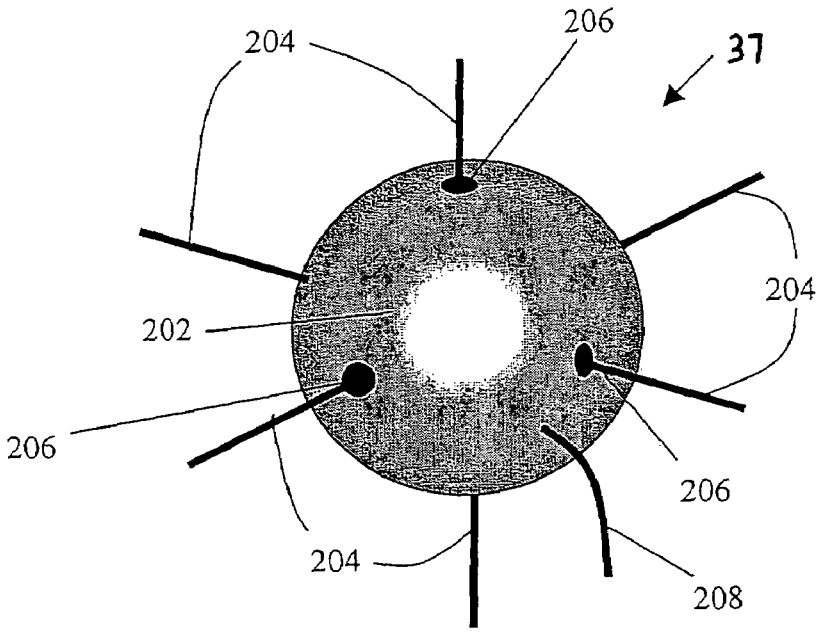
FIGS. 4A-B illustrate perspective and cross-sectional views of an exemplary gravity switch includable in the electronic dice disclosed herein.
Figure 4B:
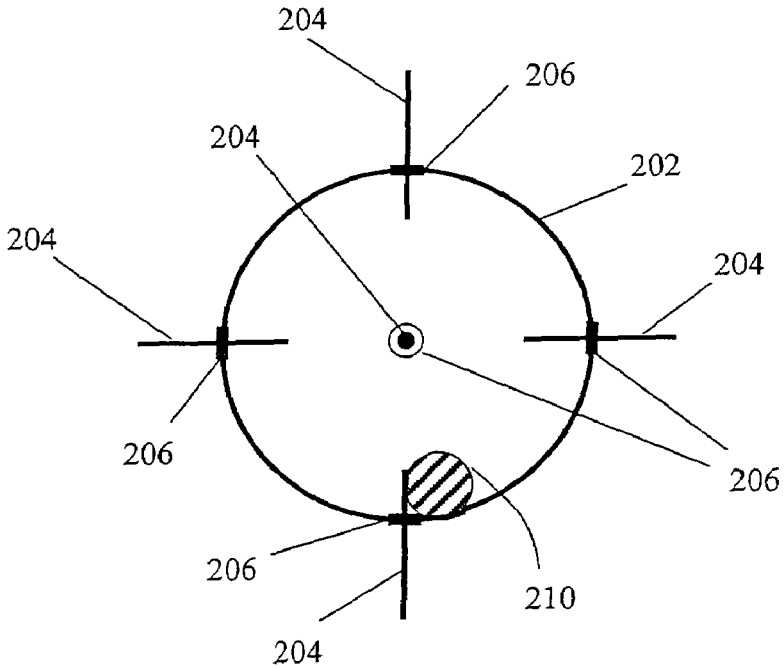

FIGS. 4A-B illustrate detailed perspective and cross-sectional views of an exemplary gravity switch 37 includable in the electronic dice disclosed herein.

FIG. 4A is a perspective view of an exemplary spherical gravity switch 37. The switch 37 includes a conductive shell 202 forming an enclosed space and a plurality of conductors 204 passing through the shell 202 into the enclosed space. The conductive shell 202 can be made of metal, such as aluminum or copper. Each of the conductors 204 corresponds to a face of the die. The switch 37 is positioned inside the die so that the conductors 204 are aligned generally perpendicular to and opposite their corresponding faces. Thus, when the switch 37 is properly mounted inside the die, e.g. on the PCB, the conductor 204 at the bottom of the switch 37 corresponds to the top side of the die, when the die is lying on one of its sides. Each of the conductors 204 can be connected to a respective input of the electronic circuit 27,174.

Insulators 206 electrically isolate the conductors 204 from the shell 202. The insulators 206 can be non-conductive grommets, plastic wire insulation, or the like. A reference conductor 208 provides an electrical path between the shell 202 and ground. Alternatively, the conductor 208 can provide a reference voltage, or signal 22 from electronic circuitry, such as discussed in the connection with FIG. 5.

As shown in the cross-sectional view of FIG. 4B, a freely movable conductor 210 is placed inside the shell 202. As shown, the freely movable conductor 210 is preferably a conductive ball, such a metal ball bearing. Other movable conductors, such as a conductive liquid, can be used instead.

The movable conductor 210 moves around inside the shell 202 as the die is shaken or tossed. When the die comes to rest on one of its faces, the movable conductor 210 comes to rest at the bottom of the shell 202, against the conductor 204 corresponding to the upward face. This establishes an electrical path between the conductor 204 and the shell 202. This essentially closes a switch between the bottom conductor 204 and reference conductor 208, thus sending a signal to the electronic circuit indicating which face is up. The signal can trigger the execution of the LED flasher IC, sound playback, or other electronic function.

Figure 5:
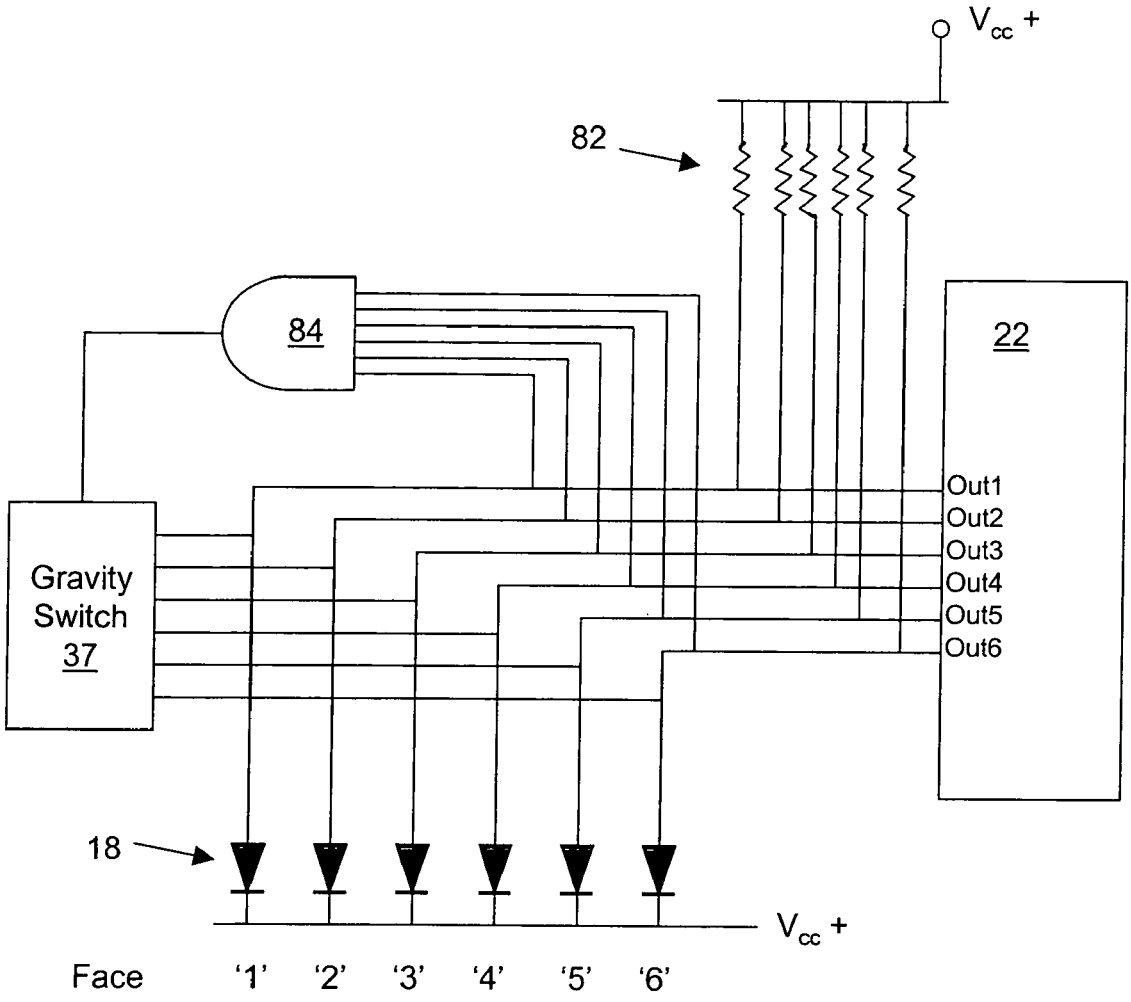
FIG. 5 is a schematic diagram of an exemplary electronic circuit that can be included in the die of FIG. 3 for causing the upward die face to remain lighted while other faces flash.

FIG. 5 is a schematic diagram of an exemplary electronic circuit 80 that can be included in the die 70 of FIG. 3 for causing the upward die face to remain lighted while other faces flash. The circuit 80 includes the LED flasher IC 22, preferably 6-LED flasher Part No. 5416 from China Resource Semiconductor, Ltd., pull-up resistors 82, and-gate 84, and gravity switch 37. The circuit 80 drives LEDs 18 on each of the die faces. Only one LED 18 per face is shown for the sake of simplicity.

The outputs (OUT1-OUT6) of the IC 22 are active low. When triggered, the IC 22 cycles low signals on each of its outputs. The low signals cause the output of the and-gate 84 to persist low while the IC 22 is activated. The and-gate 84 output is connected to the reference conductor 208 of the gravity switch 37. Each of the gravity switch conductors 204 is connected to the LED(s) 18 of a respective die face. Thus, when the die 70 is rolled and comes to a stop, the and-gate 84 generally remains low during the flashing and the gravity switch 37 provides this low output to the top facing LEDs 18. Consequently, the LEDs 18 on the top side will remain lighted while the other sides flash in sequence.

The pull-up resistors 82 pull the and-gate inputs back to a high state when the IC 22 finishes its sequence and goes inactive, thus causing the gravity switch output to go high, shutting off the top-facing LEDs.

Figure 6:
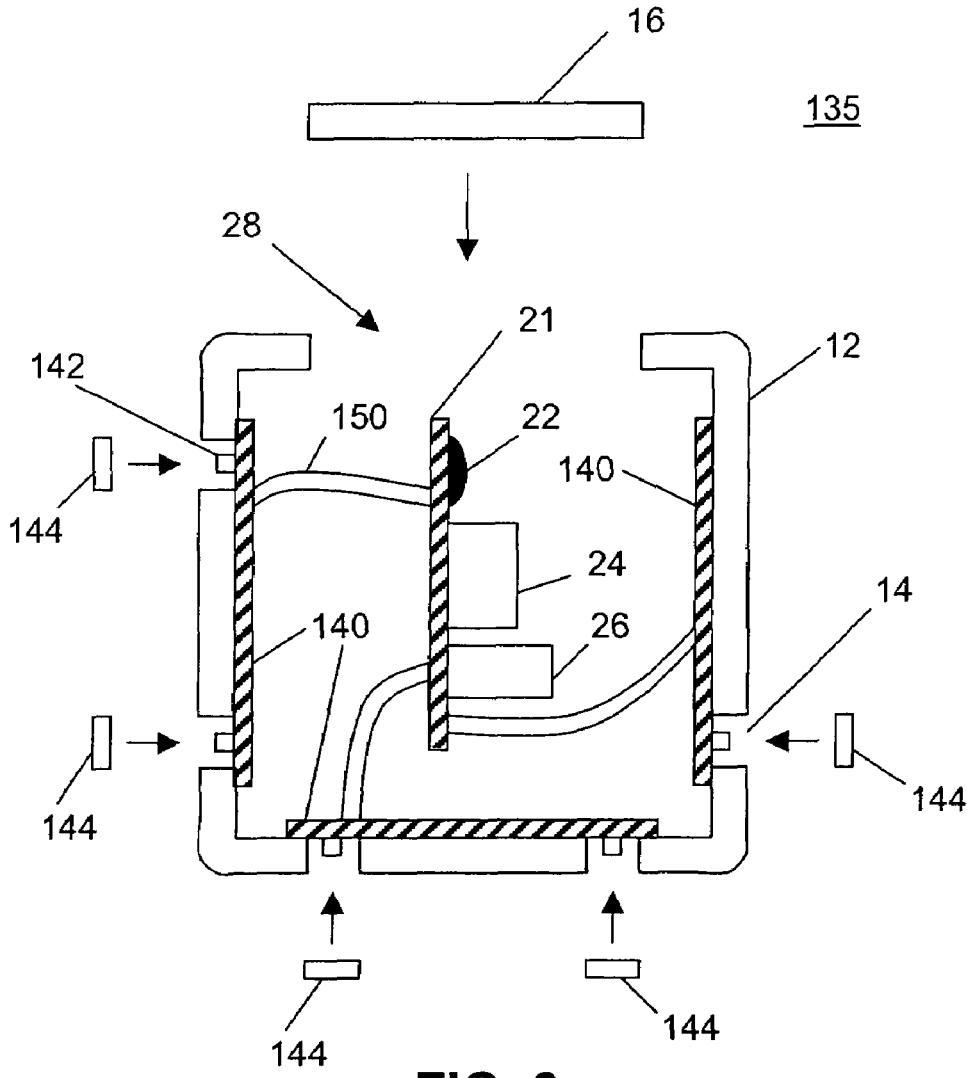
FIG. 6 is a cross-sectional view of an electronic die in accordance with a fourth exemplary embodiment of the present invention.

FIG. 6 is a cross-sectional view of an electronic die 135 in accordance with a fourth exemplary embodiment of the present invention. In this embodiment, a plurality of PCBs 140 are placed on the interior walls of the outer shell 12 and lid 16. Each PCB 140 has mounted thereon light emitters 142 for shinning out the thru-holes 14. The light emitters can be surface mounted LEDs (shown) or discrete LEDs. Each PCB 140 is connected to the LED flasher circuitry by wires 150.

Light transmissive filler plugs 144 are place in the thru-holes 14. Alternatively, transparent, self-curing liquid plastic resin can be poured into each thru-hole 14 as a substitute for the filler plugs 144. As a further alternative, light pipes (not shown) can be sandwiched between the PCBs 140 and the interior walls of the shell 12 to fill the thru-holes 14.

Figure 7:
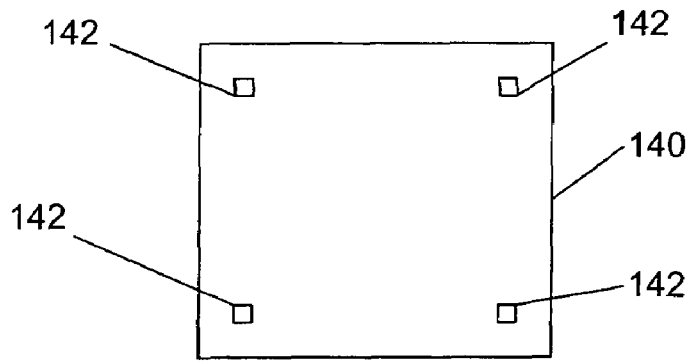
FIG. 7 shows an exemplary LED circuit board of the electronic die of FIG. 6.

FIG. 7 is a top down view of an exemplary LED circuit board 140 of the electronic die 135 of FIG. 6. The LED circuit board 140 includes four surface mount LEDs 142 for the '4' side of the die 135. The circuit board 140 also includes tracks (not shown) for supplying power to the LEDs 142. Other circuit boards 140 with different numbers of surface mount LEDs 142 are fabricated for the other faces of the die 135.

Figure 8:
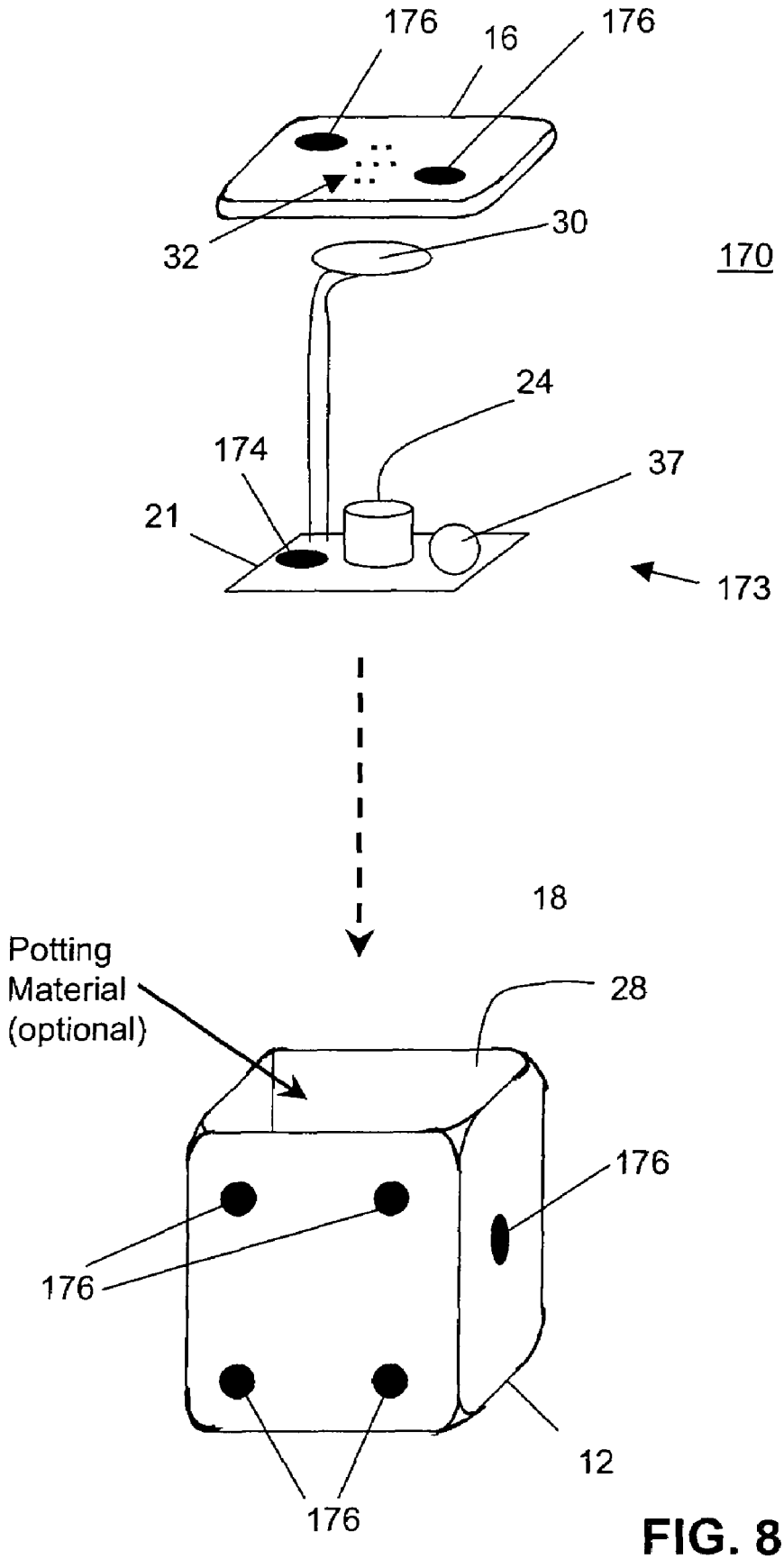
FIG. 8 is an exploded view of an electronic die in accordance with a fifth exemplary embodiment of the present invention.

FIG. 8 is an exploded view of an electronic die 170 in accordance with a fifth exemplary embodiment of the present invention. The die 170 does not include electronics for producing visual effects, but includes only electronics 173 for generating sound. The electronics 173 include a PCB 21, batteries 24, a gravity switch 37, a sound source 30, and one or more sound ICs 174. One or more holes 32 (other shapes for sound openings can be used) are formed in the lid 16 for allowing the sound to easily escape from the interior of the die 50. The sound source 30 and holes 32 can be alternatively located on one of the walls of the outer shell 12 rather than the lid 16. The sound source 30 can be housed in its own casing so that the potting material (optional in this embodiment) does not interfere with its operation. The casing can be integrally formed on the interior wall of the lid 16 or outer shell 12, or alternatively, a separate housing that is attached to the interior wall.

The electronics 173 can include any suitable electronic circuitry for generating sound. Such circuitry is commercially-available. Suitable audio playback chips for sound generation are available from Sunplus of Taiwan and ISD. The generated sound can include music, noises and/or voice messages.

The gravity switch 37 allows the sound circuitry 174 to annunciate the roll of the die 170. For example, if the die 170 is rolled to show '6', the sound circuitry 174 can announce "You rolled a six". Announcing the roll is particularly helpful for young children who do not know how to count the dots. The sound circuitry 174 can be configured to play other messages and noises. To get the circuitry 174 to play a message corresponding to each side, the messages are stored at six different starting addresses in the audio playback circuit. Each of the six output conductors of the gravity switch 37 is connected to the audio playback circuit to correspond to a respective starting address.

Alternatively/additionally, a spring switch (not shown) can be included to trigger the sound circuitry 174 when the die 170 is rolled.

In this embodiment, thru-holes are not formed in the lid 16 and outer shell 12. Instead, dots 176 are painted, embossed or otherwise formed on the exterior surfaces of the lid 16 and outer shell 12.

Figure 10:
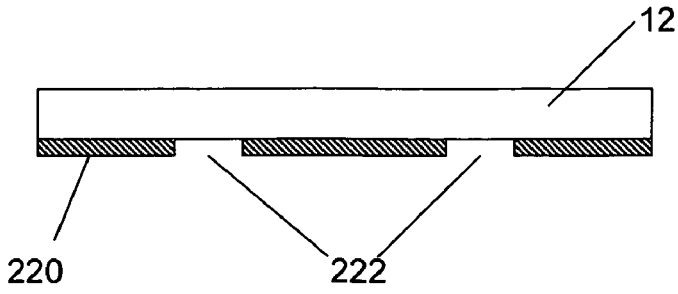
FIG. 10 is a cross-sectional view of a portion of a transparent outer shell of an electronic die showing an opaque layer applied thereto to form light-emitting dots.

The invention may also assume embodiments other than those set out and described above. For example, thru-holes in the outer shell and lid are not necessary to present flashing, light up dots or indicia. As an alternative to thru-holes, as shown in FIG. 10, the outer shell 12 and lid 16 can be transparent with light emitters placed on their interior walls. The exterior of the die can be plated or painted 220 using a mask to leave an exposed dot pattern 222 or other indicia on the outside of the transparent shell and lid. Also, the die can have an outer shell with two halves, rather than a five-sided box with a lid.

While specific embodiments of the present invention have been shown and described, it will be apparent to those skilled in the art that the disclosed invention may be modified in numerous ways and may assume many embodiments other than those specifically set out and described above. Accordingly, the scope of the invention is indicated in the appended claims, and all changes that come within the meaning and range of equivalents are intended to be embraced therein.

What we claim is:

1. An electronic gaming die for randomly selecting an outcome that is a number between one and six, comprising:

a six-sided, cube-shaped shell defining the exterior of the electronic die, each side of the cube-shaped shell representing a predetermined outcome that is distinct from the outcomes represented by the other sides of the cube-shaped shell, the cube-shaped shell being adapted to be rolled by a user to determine the outcome;

a first side of the cube-shaped shell representing the number one;

a second side of the cube-shaped shell representing the number two;

three light-emitting pips located on a third side of the cube-shaped shell, representing the number three;

four light-emitting pips located on a fourth side of the cube-shaped shell, representing the number four;

five light-emitting pips located on a fifth side of the cube-shaped shell, representing the number five;

six light-emitting pips located on a sixth side of the cube-shaped shell, representing the number six, whereby the electronic die includes a total of at least nineteen light-emitting pips;

an electronic circuit, located within the cube-shaped shell, for causing, in response to a triggering input, the at least nineteen light-emitting pips on the sides of the cube-shaped shell to light up in a predetermined pattern that has a predetermined duration, the electronic circuit including an integrated circuit (IC) for illuminating one or more light emitting diodes (LEDs) illuminating the at least nineteen light-emitting pips according to the predetermined pattern, the IC being COB-mounted to a printed circuit board (PCB) for miniaturizing the electronic circuit and configured in a one-shot mode so that the LEDs illuminate for the predetermined duration upon occurrence of the trigger input;

a sensor, located within the cube-shaped shell, for providing the triggering input to trigger the electronic circuit to illuminate the at least nineteen light-emitting pips according to the predetermined pattern in response to the electronic die being physically manipulated; and at least one battery, located in the cube-shaped shell, for powering the electronic circuit.

2. The electronic die of claim 1, further comprising a light pipe located at least partially within the shell for transferring light from the LEDs to at least one of the light-emitting pips.

3. The electronic die of claim 1, wherein the shell is transparent and the electronic die further comprises an opaque layer of material disposed on the transparent shell in a predetermined pattern defining the light-emitting pips.

4. The electronic die of claim 1, wherein the at least one battery is a coin cell battery.

5. The electronic die of claim 1, further comprising:

potting material placed inside the cube-shaped shell.

6. The electronic die of claim 1, further comprising:

one light-emitting pip located on the first side of the shell, representing the number one.

7. The electronic die of claim 1, further comprising:

two light-emitting pips located on a second side of the shell, representing the number two.

8. The electronic die of claim 1, wherein each of the pips includes one of the LEDs.

9. The electronic die of claim 1, further comprising an audio generator.

10. The electronic die of claim 1, wherein the sensor includes:

a switch, located within the cube-shaped shell and operatively coupled to the electronic circuit, for indicating which of the shell sides is facing up.

11. The electronic die of claim 10, further comprising an audio generator, operatively coupled to the switch, for playing a voice message announcing a roll outcome indicated by the upward-facing side of the shell.

12. An electronic die, comprising:

a six-sided, cube-shaped shell defining the exterior of the electronic die, each side of the cube-shaped shell representing a predetermined outcome that is distinct from the outcomes represented by the other sides of the cube-shaped shell;

a first side of the shell representing the number one;

a second side of the shell representing the number two;

three light-emitting pips located on a third side of the shell, representing the number three;

four light-emitting pips located on a fourth side of the shell, representing the number four;

five light-emitting pips located on a fifth side of the shell, representing the number five;

six light-emitting pips located on a sixth side of the shell, representing the number six, whereby the electronic die includes a total of at least nineteen light-emitting pips;

at least one light source, attached to a printed circuit board (PCB) contained internally within the shell, for illuminating the pips;

a light pipe located within the shell and having an end attached to the at least one light source and one or more fingers terminating on the exterior of the shell at one or more of the light-emitting pips, for transferring light from the at least one light source to at least some the light-emitting pips;

an electronic circuit, located within the shell, for causing, in response to a triggering input, the at least one light source to illuminate in a predetermined pattern that has a predetermined duration, the electronic circuit including an integrated circuit (IC) for illuminating the at least one light source according to the predetermined pattern, the IC being COB-mounted to the PCB for miniaturizing the electronic circuit and configured in a one-shot mode so that the at least one light source illuminates for the predetermined duration upon occurrence of the triggering input;

a sensor, located within the shell, for providing the triggering input to trigger the electronic circuit to light up the at least one light source according to the predetermined pattern in response to the electronic die being physically manipulated; and at least one battery, located in the cube-shaped shell, for powering the electronic circuit and the at least one light source.

13. The electronic die of claim 12, wherein the shell is transparent and the electronic die further comprises an opaque layer of material disposed on the transparent shell in a predetermined pattern defining the light-emitting pips.

14. The electronic die of claim 12, further comprising:

potting material placed inside the cube-shaped shell.

15. The electronic die of claim 12, further comprising:

one light-emitting pip located on the first side of the shell, representing the number one.

16. The electronic die of claim 12, further comprising:

two light-emitting pips located on a second side of the shell, representing the number two.

17. The electronic die of claim 12, further comprising an audio generator.

18. The electronic die of claim 12, wherein the sensor includes:

a switch, located within the cube-shaped shell and operatively coupled to the electronic circuit, for indicating which of the shell sides is facing up.

19. The electronic die of claim 18, further comprising an audio generator, operatively coupled to the switch, for playing a voice message announcing a roll outcome indicated by the upward-facing side of the shell.

20. An electronic die, comprising:

a six-sided, cube-shaped shell defining the exterior of the electronic die, each side of the cube-shaped shell representing a predetermined outcome that is distinct from the outcomes represented by the other sides of the cube-shaped shell;

a first side of the cube-shaped shell representing the number one;

a second side of the cube-shaped shell representing the number two;

three light-emitting pips located on a third side of the cube-shaped shell, representing the number three;

four light-emitting pips located on a fourth side of the cube-shaped shell, representing the number four;

five light-emitting pips located on a fifth side of the cube-shaped shell, representing the number five;

six light-emitting pips located on a sixth side of the cube-shaped shell, representing the number six, whereby the electronic die includes a total of at least nineteen light-emitting pips;

an electronic circuit, located within the cube-shaped shell, for causing, in response to a triggering input, the at least nineteen light-emitting pips on the sides of the cube-shaped shell to light up in a predetermined pattern that has a predetermined duration, the electronic circuit including an integrated circuit (IC) for illuminating one or more light emitting diodes (LEDs) illuminating the at least nineteen light-emitting pips according to the predetermined pattern, the IC being circuit-on-board (COB) mounted to a printed circuit board (PCB) and configured in a one-shot mode so that the LEDs illuminate for the predetermined duration upon occurrence of the trigger input;

a sensor, located within the cube-shaped shell, for providing the triggering input to trigger the electronic circuit to illuminate the at least nineteen light-emitting pips according to the predetermined pattern in response to the electronic die being physically manipulated, the sensor including a switch, for indicating which of the shell sides is facing up;

an audio generator, operatively coupled to the switch, for playing a voice message announcing a roll outcome indicated by the upward-facing side of the shell; and at least one battery, located in the cube-shaped shell, for powering the electronic circuit.

* * * * *